US007452403B2

(12) United States Patent
Younsi et al.

(10) Patent No.: US 7,452,403 B2
(45) Date of Patent: Nov. 18, 2008

(54) SYSTEM AND METHOD FOR APPLYING PARTIAL DISCHARGE ANALYSIS FOR ELECTROSTATIC PRECIPITATOR

(75) Inventors: Abdelkrim Younsi, Ballston Lake, NY (US); Yingneng Zhou, Niskayuna, NY (US); David Fulton Johnston, Poquoson, VA (US); Terry Lewis Farmer, Kearney, MO (US); Robert Warren Taylor, Overland Park, KS (US)

(73) Assignee: General Electric Company, Niskayuna, NY (US)

( * ) Notice: Subject to any disclaimer, the term of this patent is extended or adjusted under 35 U.S.C. 154(b) by 284 days.

(21) Appl. No.: 11/321,832

(22) Filed: Dec. 29, 2005

(65) Prior Publication Data

US 2007/0151446 A1 Jul. 5, 2007

(51) Int. Cl.
*B03C 3/68* (2006.01)

(52) U.S. Cl. ..... 95/5; 95/6; 95/7; 96/21; 96/22; 96/24; 323/903; 324/457

(58) Field of Classification Search ..... 96/18–24, 96/80–82; 95/2, 5–7; 323/903; 324/457, 324/458

See application file for complete search history.

(56) References Cited

U.S. PATENT DOCUMENTS

| | | | | |
|---|---|---|---|---|
| 3,173,772 | A * | 3/1965 | Gelfand | 96/21 |
| 4,390,831 | A * | 6/1983 | Byrd et al. | 323/240 |
| 4,659,342 | A * | 4/1987 | Lind | 95/5 |
| 4,854,948 | A * | 8/1989 | Eiserlo et al. | 96/20 |
| 4,860,149 | A * | 8/1989 | Johnston | 361/79 |
| 5,471,377 | A * | 11/1995 | Donig et al. | 95/5 |
| 6,563,319 | B1 * | 5/2003 | Kraz | 324/458 |
| 6,614,235 | B2 * | 9/2003 | Kraz | 324/457 |
| 6,762,607 | B2 * | 7/2004 | Kraz | 324/458 |
| 6,951,582 | B1 * | 10/2005 | Tsai et al. | 96/18 |
| 2005/0178265 | A1 | 8/2005 | Altman et al. | 95/2 |

OTHER PUBLICATIONS

IEEE Std 1434-2000, IEEE Trial-Use Guide to the Measurement of Partial Discharges in Rotating Machinery, Apr. 26, 2000.

* cited by examiner

*Primary Examiner*—Richard L Chiesa
(74) *Attorney, Agent, or Firm*—Ann M. Agosti

(57) ABSTRACT

A system for detecting partial discharge activity in an electrostatic precipitator is provided. The system includes one or more sensors configured to receive and transmit signals representative of voltage or current behavior of the electrostatic precipitator. The system also includes a processor configured to receive the signals from the one or more sensors and configured for detecting one or more occurrences of partial discharge activity in the electrostatic precipitator.

26 Claims, 5 Drawing Sheets

SYSTEM AND METHOD FOR APPLYING PARTIAL DISCHARGE ANALYSIS FOR ELECTROSTATIC PRECIPITATOR

BACKGROUND

The invention relates generally to electrostatic precipitators and more specifically to a system and method for detecting partial discharge activity in electrostatic precipitators and their components.

Many industrial operations produce exhaust gases that contain dust, fly ash (unburned constituents from burning), fumes (fine elemental particles such as cadmium, sulfur and lead) and mist (such as coal tar), which are undesirable for the environment. One widely used method of removing such contaminants from a gas stream is to use an electrostatic precipitator.

In one example, electrostatic precipitators are composed of metallic plates subjected to a potential difference in order to exploit the corona activity and capture the electrostatically charged dust of the smoke exiting from the smokestack of a factory. The plates are bumped at regular intervals (for dust removal), and the dust is then collected at the bottom of the electrostatic precipitators. Because higher voltages result in more efficient dust collection, the voltage is typically increased until sparking, i.e. electrode short-circuit, occurs. Such sparking then causes the voltage to drop off, and the process of starting at a low voltage and ramping to a higher one starts. During the voltage drop off, dust is not collected, and emissions increase. Sparks sometimes result in damage of the electrode surface which can lead to failure of the electrostatic precipitator. Most customers retain their electrostatic precipitators as a primary or a secondary device for emission control. The electrostatic precipitators are also recently being considered for integration into future mercury and sulfur solutions as well for lighting industry. Thus it is increasingly becoming important to have better operating and maintenance procedures for electrostatic precipitators.

Partial discharge analysis is a non-destructive and a non-invasive testing technique to detect different defect types in materials. A partial discharge is a localized electric discharge in which the distance between the two electrodes is only partially bridged. In other words, partial discharge refers to the dissipation of energy caused by the localized build-up of an electrical field in an insulating material. Partial discharges are most commonly observed in medium to high-voltage devices such as transformers, cables and generators. In these devices, occurrence of partial discharges can be indicative of insulation deterioration. Partial discharges can also cause further deterioration of the insulating dielectric material. Early detection of partial discharges helps prevent insulation breakdown, avert damage of insulation systems, extend the lifetime of the insulation, and help in efficient maintenance planning.

Different dielectrics and insulation systems have different partial discharge signatures. In rotating machines for example, partial discharge analysis has been used in the past to define material defects such as delaminations in conductors and insulators, winding armor degradation, voids, contamination, and corona suppressor damage. Although partial discharge analysis is a powerful tool, its use has been limited as a tool for detecting material defects.

BRIEF DESCRIPTION

Embodiments of the present invention relate to using the partial discharge for monitoring electrostatic precipitator activity and optionally for providing improved performance of the electrostatic precipitator. According to one embodiment, a system for detecting partial discharge activity in an electrostatic precipitator is provided. The system includes one or more sensors configured to receive and transmit signals representative of voltage or current pulses behavior of the electrostatic precipitator, and a processor configured to receive the signals from the one or more sensors and configured for detecting one or more occurrences of partial discharge activity in the electrostatic precipitator.

According to another aspect of the invention, a method for monitoring partial discharge activity in an electrostatic precipitator is provided. The method includes obtaining current or voltage data from the electrostatic precipitator, detecting patterns in the data indicative of partial discharge; and analyzing the patterns for determining a normal condition or an aging condition of one or more components of the electrostatic precipitator.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
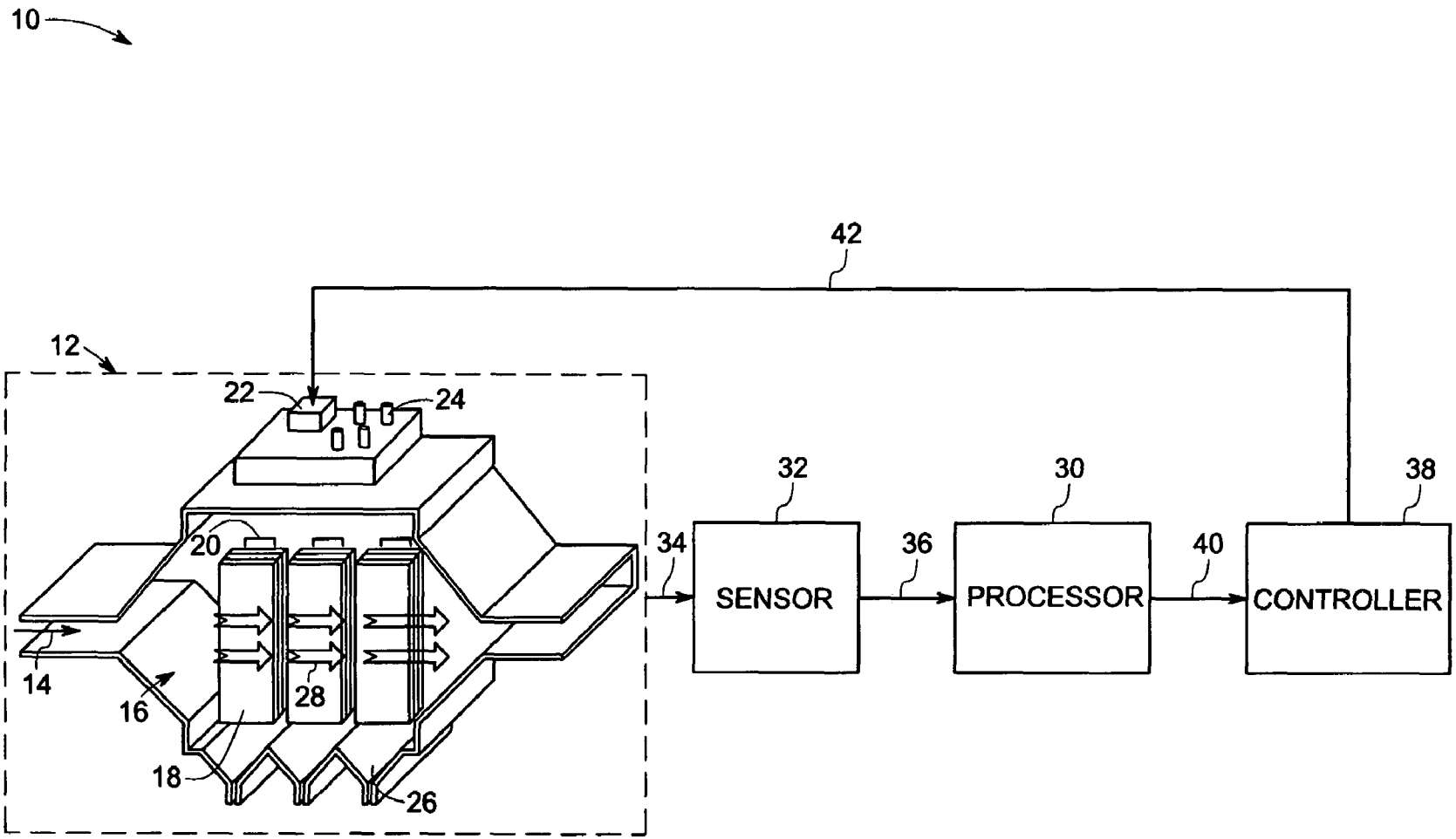
FIG. 1 is a diagrammatic representation of a system for detecting partial discharge activity in an electrostatic precipitator.

FIG. 1 is a diagrammatic representation of a system 10 for detecting partial discharge activity in an electrostatic precipitator 12. The electrostatic precipitator 12 is used for extracting pollutants such as particles caught in the flow of gas (shown generally by reference numeral 14) that move through a collector chamber 16 or passageway containing sets of collecting electrodes 18 in the form of parallel plates, bundles of tubes, or simply the collector's inner walls. The plates, tubes or inner walls serve as grounded electrodes that act as particle collectors. Discharge electrodes 20 are situated within but insulated electrically from the rest of the chamber 16 and are charged with high direct voltage via a high voltage power supply 22. The electrical charge ionizes (charges) the suspended particles, causing them to move toward the collecting electrodes. In another example (not shown) of the electrostatic precipitator, opposite high voltages (plus and minus) are charged on two plates or grids. The positive grid charges the particles, and the negative grid attracts (collects) them. If the material collected is dry, every so often the collecting electrodes 18 are tapped or rapped by using bumpers 24 (which are also referred to as rappers) to loosen the layer of particles, which fall into hoppers 26 for collection and disposal. The electrostatic precipitator is thus able to extract pollutants and release clean gas or air, as shown by the arrows designated generally as 28. It may be noted that the configuration of the electrostatic precipitator as shown and described herein is merely an exemplary illustration and is a non-limiting example and that other configurations for the electrostatic precipitator are equally applicable.

Figure 2:
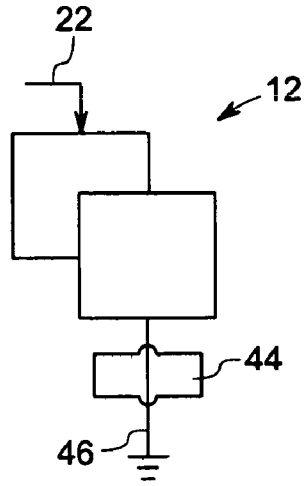
FIG. 2 is a diagrammatic representation of an exemplary sensor used in the system of FIG. 1 where the sensor is disposed on a ground lead of a high voltage power supply coupled to the electrostatic precipitator.
Figure 3:
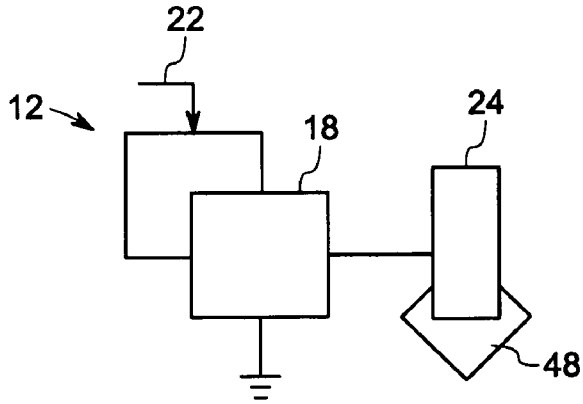
FIG. 3 is a diagrammatic representation of another exemplary sensor used in the system of FIG. 1 where the sensor is disposed on a bumper of the electrostatic precipitator.
Figure 4:
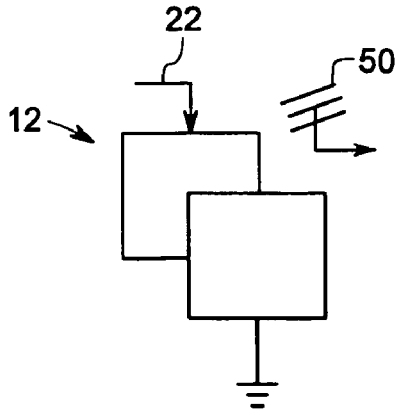
FIG. 4 is a diagrammatic representation of another exemplary sensor used in the system of FIG. 1 where the sensor is an antenna disposed about a high voltage power supply coupled to the electrostatic precipitator.

Referring again to FIG. 1, the electrostatic precipitator 12 is coupled electrically to a processor 30 via one or more sensors 32. The processor 30 is a partial discharge analyzer in one example. The processor may also include control features for controlling the input from the sensors 32 and also the input to the electrostatic precipitator 12 and is configured for detecting one or more occurrences of partial discharge activity in the electrostatic precipitator 12. The one or more sensors 32 are configured to receive signals 34 and transmit the signals 36. The signals 34 and 36 are representative of voltage or current behavior (with "or" meaning voltage, current, or both) of the electrostatic precipitator. Some exemplary implementations of the sensors 32 are shown in FIGS. 2-4. In a specific example a controller 38 may be provided that is configured to receive an output 40 from the partial discharge analyzer and send a control signal 42 to the electrostatic precipitator 12 for controlling one or more operating parameters with one example being voltage across the electrostatic precipitator 12.

Figure 5:
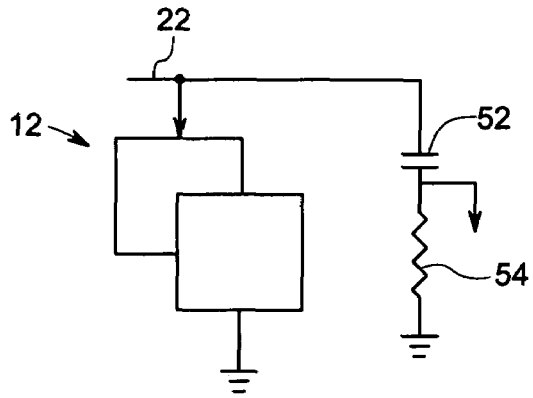
FIG. 5 is a diagrammatic representation of another exemplary sensor used in the system of FIG. 1 where the sensor is a high voltage capacitor connected to the high voltage power supply coupled to the electrostatic precipitator.

FIGS. 2-5 illustrate some non-limiting examples of positioning the sensors, for example high frequency current transformer (HFCT) clamps 44 located on the grounded side of the electrostatic precipitator 12, high voltage capacitors connected to the output terminal of the high voltage power supply 22 or an antenna 50 located in close proximity to the high voltage power supply 22. FIG. 2 illustrates a system where the HFCT sensor 44 is disposed on a ground lead 46 of a high voltage power supply 22 coupled to the electrostatic precipitator 12. The sensor in this example is a 30 mm HFCT clamp. FIG. 3 illustrates a system where the sensor 48 is disposed around a bumper 24 of the electrostatic precipitator 12. In one example the sensor 48 is a HFCT with a window ranging from 10 mm to 200 mm. FIG. 4 illustrates a system wherein the sensor 50 is an antenna disposed about a high voltage power supply 22 coupled to the electrostatic precipitator 12. FIG. 5 illustrates a system where the sensor is a high voltage capacitor 52 connected via a resistor 54 to the high voltage power supply terminal 22.

Figure 6:
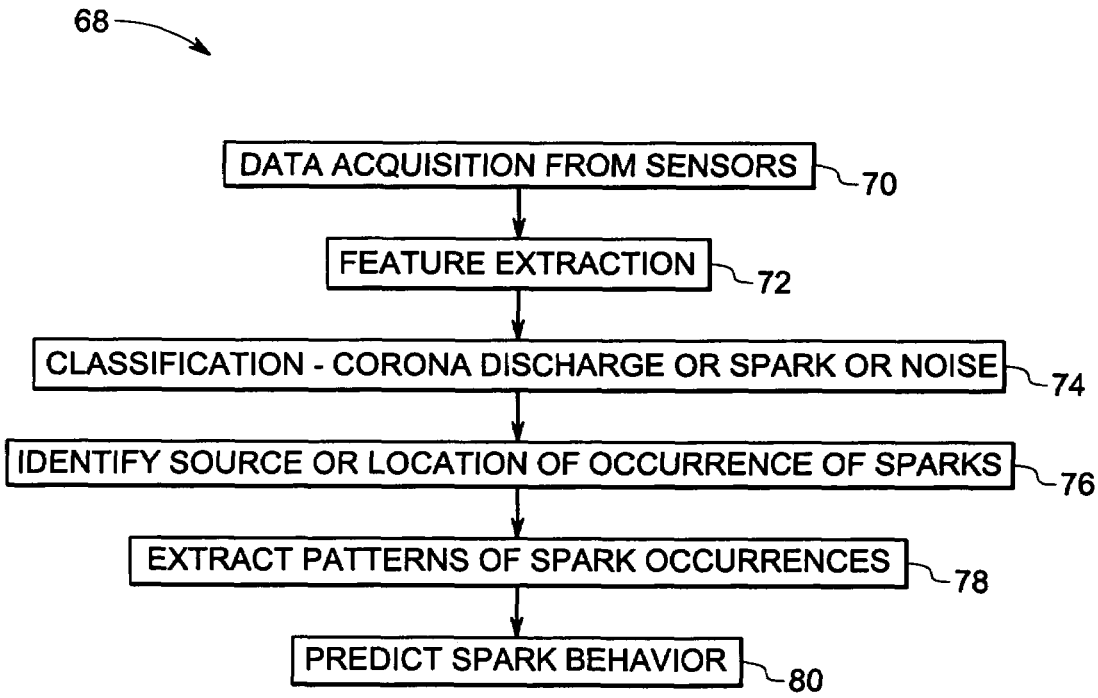
FIG. 6 is a flowchart illustrating exemplary steps for the functioning of a processor or a partial discharge analyzer of FIG. 1.

FIG. 6 illustrates a flow diagram 68 for the functioning of the processor or the partial discharge analyzer 42 of FIG. 1. At step 70 the partial discharge analyzer acquires the data from the sensors. The data is in the forms of signals representative of voltage or current behavior of the electrostatic precipitator as discussed with reference to FIG. 1. At step 72 the partial discharge analyzer extracts features from the data related to occurrences of partial discharge in the electrostatic precipitator. At step 74 the partial discharge analyzer classifies the features to determine if the partial discharge is related to a corona discharge or a spark or a commutation noise. At step 76 the partial discharge analyzer identifies a source or location of the occurrences of sparks. At step 78 the partial discharge analyzer is further configured in one example to extract patterns of the occurrences of sparks from partial discharge data collected over a period of time. And at step 80 the partial discharge analyzer is configured to predict spark behavior in the electrostatic precipitator based on the patterns. An example of partial discharge pulse waveform features used to recognize sparking sources can be any one or more of the following centroid of negative PD shape; maximum peak values of pulses; second order moment of partial discharge magnitude; second order moment of partial discharge pulse phase; or maximum of negative partial discharge magnitude. Thus the partial discharge analyzer is configured to collect data over time and provide indicators for improving control and operation of the electrostatic precipitator. The output from the partial discharge analyzer, in one example may be used to send a control signal to the electrostatic precipitator for controlling one or more operating parameters with one example being voltage across the electrostatic precipitator. The partial discharge analyzer is therefore used to advantageously quantify and identify detrimental trends in the electrostatic precipitator and provides on-line or off-line flexibility and allows conditioned-based maintenance for the electrostatic precipitator.

The partial discharge measurements result in an efficient technique for collecting information about the electrical activity on the plates of the electrostatic precipitator. Moreover, the partial discharge analysis distinguishes between the corona signals, the sparks and the commutation noise, due to the solid-state switches of the AC/AC voltage supply. The data analysis obtained from the partial discharge analysis, as shown in the exemplary graphs in FIGS. 7-8, is very useful for understanding the spark activity at the plates of the electrostatic precipitator.

Figure 7:
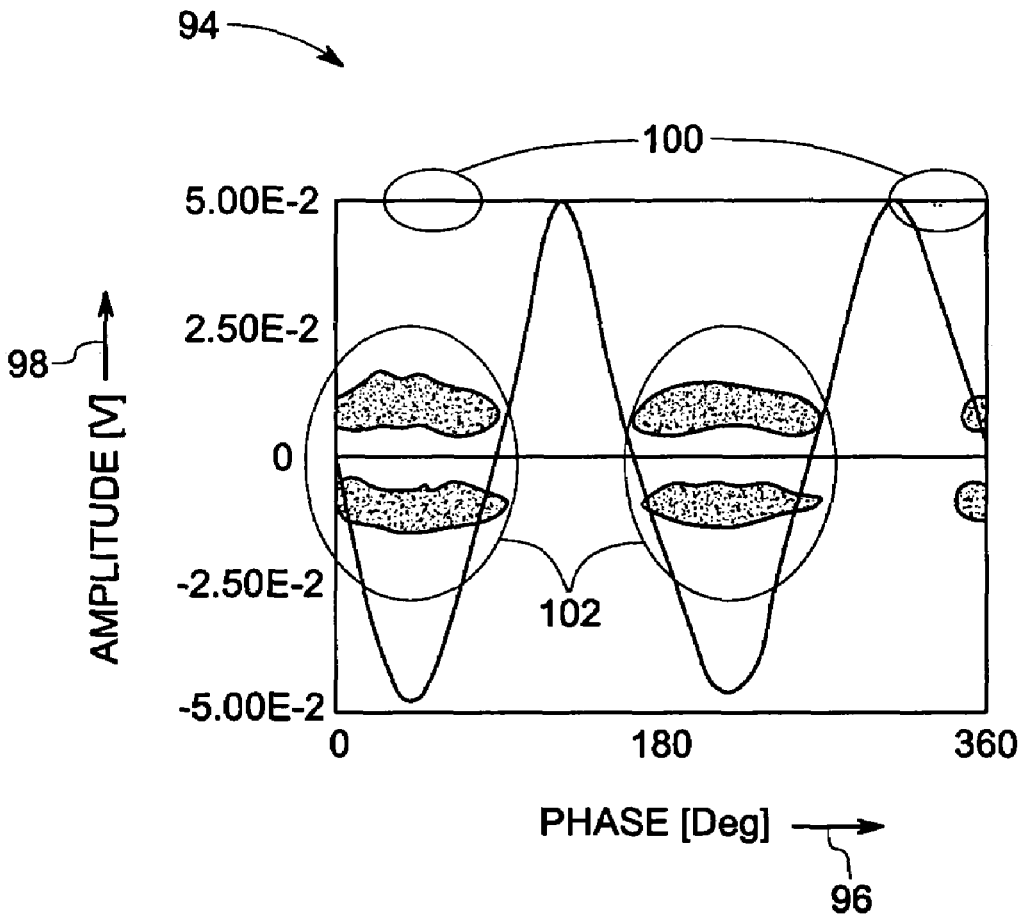
FIG. 7 is a graphical representation showing spark and corona occurrences as detected by the processor or a partial discharge analyzer of FIG. 1.

The graph 94 in FIG. 7 shows an example of corona activity acquired on the ground plate or the collecting electrode 18 (FIG. 1) with a HFCT clamp (sensor). The X-axis denoted generally by 96 shows the phase during the acquisition period and the Y-axis denoted generally by 98 shows the amplitude of the signal. In another example within an acquisition period of 4.21 seconds long two sparks 100 occurred and were collected together with the corona signals 102. It was possible to recognize both the spark and corona signals due to their respective amplitudes.

Figure 8:
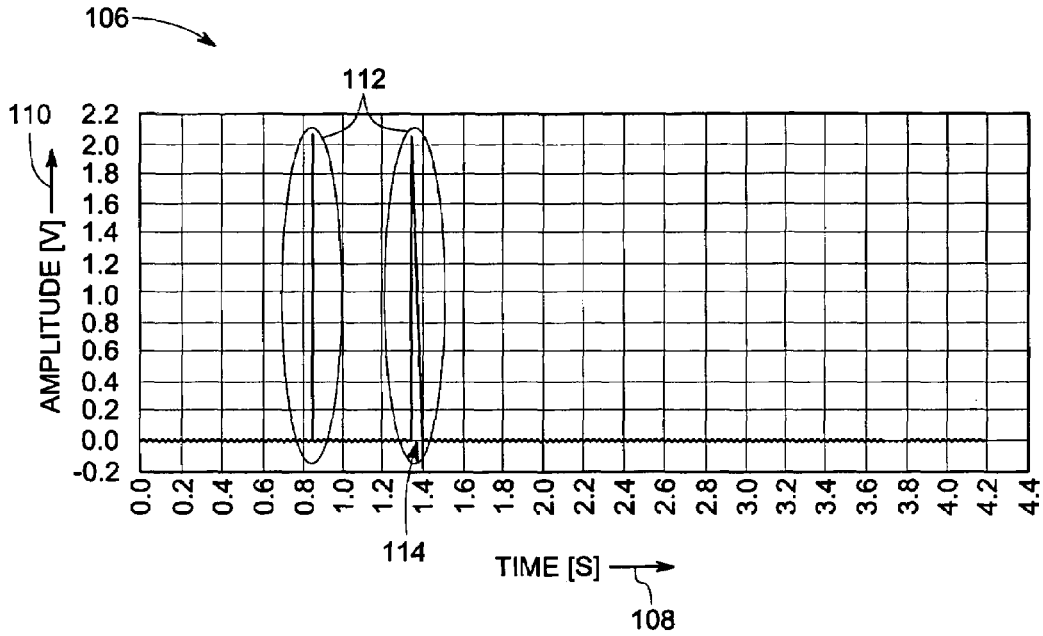
FIG. 8 is a graphical representation showing the time lapse after the spark occurrences.

In order to understand the time vs. amplitude behavior of the activity, the pattern has been expanded in the graph 106 of FIG. 8. The X-axis is denoted by 108 and shows the time in seconds and the Y-axis is denoted by 110 and shows the amplitude of the signal. Again as described above it is possible to recognize the spark occurrences shown generally by reference numeral 112 due to the amplitude difference. These patterns collected over a period of time are analyzed in one example and used to define allowable boundaries of operation for the electrostatic precipitators.

Figure 9:
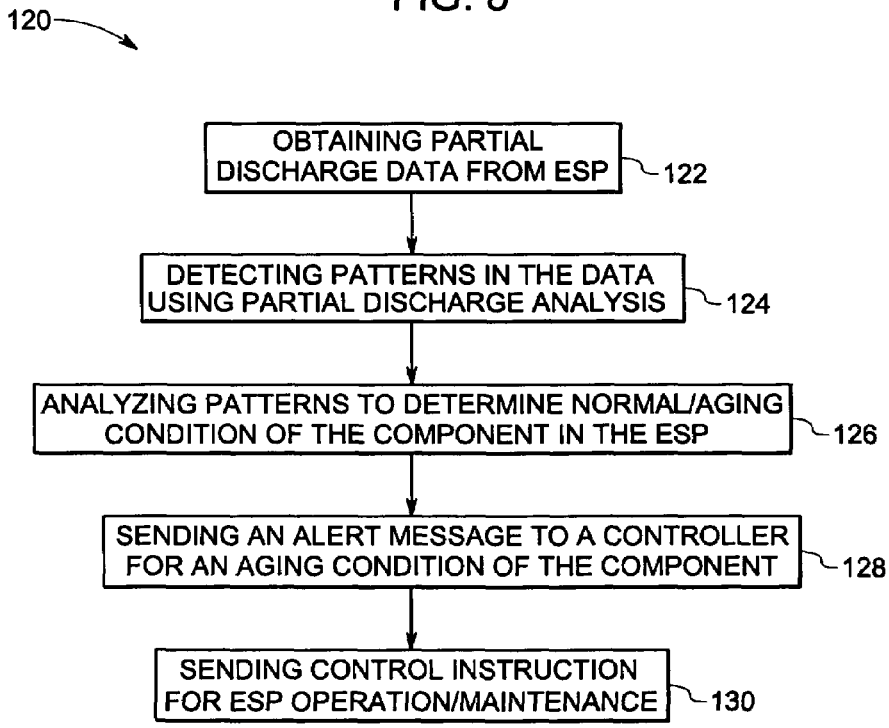
FIG. 9 is a flowchart showing exemplary steps for a method for monitoring partial discharge activity in the electrostatic precipitator of FIG. 1.

FIG. 9 is a flowchart 120 to illustrate exemplary steps for a method for monitoring partial discharge activity in an electrostatic precipitator. The method at step 122 includes obtaining partial discharge data from the electrostatic precipitator. At step 124, the method includes detecting patterns in the data using partial discharge analysis, and at step 126 analyzing the patterns for determining a normal condition or an aging condition of one or more components of the electrostatic precipitator. The method may further include in one example a step 128 for sending an alert message to a controller if an unacceptable aging condition is detected. As used herein "unacceptable aging condition" implies as a condition where continued use is potentially undesirable or will be in within a few days or hours. For improved control and maintenance of the electrostatic precipitator the method may further include a step 130 for sending control instructions or signals for operating the electrostatic precipitator within an allowable voltage range or for the maintenance of the electrostatic precipitator.

Thus, as explained herein the partial discharge measurements are advantageously used to detect the corona activity in the electrostatic precipitator to find controls parameters that allows the electrostatic precipitator to operate at an optimized spark rate. This leads to a better operation of the electrostatic precipitator and, as a consequence, to an increase of its life and a decrease of the air pollution.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for detecting partial discharge activity in an electrostatic precipitator, the system comprising:

one or more sensors configured to receive and transmit signals representative of voltage or current behavior of the electrostatic precipitator; and a processor configured to receive the signals from the one or more sensors and configured for detecting one or more occurrences of partial discharge activity in the electrostatic precipitator.

2. The system of claim 1 wherein the sensor is disposed on a bumper of the electrostatic precipitator.

3. The system of claim 2 wherein the bumper is coupled to a ground plate of the electrostatic precipitator.

4. The system of claim 1 wherein the sensor is disposed on a ground lead of a high voltage power supply coupled to the electrostatic precipitator.

5. The system of claim 1 wherein the sensor is an antenna disposed about a high voltage power supply coupled to the electrostatic precipitator.

6. The system of claim 1 wherein the processor is configured to process the signals and detect aging of one or more components of the electrostatic precipitator.

7. The system of claim 1 wherein the processor is further configured to analyze spark patterns in the electrostatic precipitator.

8. The system of claim 1 wherein the occurrence is at least one of sparking, corona discharge and commutation noise.

9. The system of claim 1 wherein the processor is configured to collect data over time, and further comprising a controller for using the processed data to issue a control signal to the electrostatic precipitator.

10. The system of claim 1, the processor being configured for:

extracting features from the data related to occurrences of partial discharge in the electrostatic precipitator;

classifying the features to determine if the partial discharge is related to a corona discharge or a spark or a commutation noise;

identifying sources or locations of the occurrences of sparks;

extracting patterns of the occurrences of sparks from partial discharge data collected over a period of time; and predicting spark behavior in the electrostatic data based on the patterns.

11. The system of claim 1 wherein the processor is a partial discharge analyzer.

12. The system of claim 1 wherein the sensor comprises a capacitor connected to a high voltage power supply coupled to the electrostatic precipitator.

13. The system of claim 1 wherein the processor is further configured to analyze patterns of the detected one or more occurrences of partial discharge and determine detrimental trends therefrom.

14. An electrostatic precipitator system, the system comprising:

an electrostatic precipitator for extracting pollutants; and a partial discharge analyzer coupled electrically to the electrostatic precipitator and configured for detecting one or more occurrences of partial discharge activity in the electrostatic precipitator.

15. The system of claim 14 further comprising one or more sensors configured to receive signals representative of voltage or current behavior of the electrostatic precipitator and to transmit the signals to the partial discharge analyzer.

16. The system of claim 15 wherein the partial discharge analyzer is configured to process the signals and detect aging of one or more components of the electrostatic precipitator.

17. The system of claim 14 wherein the partial discharge analyzer is further configured to analyze spark patterns in the electrostatic precipitator.

18. The system of claim 14 wherein the occurrence is at least one of sparking, corona discharge and commutation noise.

19. The system of claim 14 wherein the partial discharge analyzer is configured to collect data over time, and further comprising a controller for using the data to issue a control signal to the electrostatic precipitator.

20. The system of claim 14 wherein the sensor comprises a capacitor connected to a high voltage power supply coupled to the electrostatic precipitator.

21. The system of claim 14 wherein the partial discharge analyzer is further configured to analyze patterns of the detected one or more occurrences of partial discharge and determine detrimental trends therefrom.

22. A method for monitoring partial discharge activity in an electrostatic precipitator, the method comprising obtaining current or voltage data from the electrostatic precipitator;

detecting patterns in the data indicative of partial discharge; and analyzing the patterns for determining a normal condition or an aging condition of one or more components of the electrostatic precipitator.

23. The method of claim 22 further comprising sending an alert message to a controller if an unacceptable aging condition is detected.

24. The method of claim 22 further comprising providing control instructions for operating the electrostatic precipitator within an allowable voltage range.

25. The method of claim 22 further comprising collecting the current or voltage data over a period of time for an electrostatic precipitator.

26. The method of claim 22, the detecting and analyzing further comprising:

extracting features from the data related to occurrences of partial discharge in the electrostatic precipitator;

classifying the features to determine if the partial discharge is related to a corona discharge or a spark or a commutation noise;

identifying sources or locations of the occurrences of sparks;

extracting patterns of the occurrences of sparks from partial discharge data collected over a period of time; and predicting spark behavior in the electrostatic data based on the patterns.

* * * * *